US006893284B1

(12) United States Patent
Fawcett et al.

(10) Patent No.: US 6,893,284 B1
(45) Date of Patent: May 17, 2005

(54) ISOLATING CONNECTOR

(75) Inventors: Michael J. Fawcett, Lancashire (GB); Peter Eric Ryde, Lancashire (GB)

(73) Assignee: Rota Engineering, Limited, Bury (GB)

( * ) Notice: Subject to any disclaimer, the term of this patent is extended or adjusted under 35 U.S.C. 154(b) by 0 days.

(21) Appl. No.: 09/890,807

(22) PCT Filed: Feb. 4, 2000

(86) PCT No.: PCT/GB00/00312

§ 371 (c)(1),
(2), (4) Date: Jan. 3, 2002

(87) PCT Pub. No.: WO00/46884

PCT Pub. Date: Aug. 10, 2000

(30) Foreign Application Priority Data

Feb. 5, 1999 (GB) ..... 9902467

(51) Int. Cl.[7] ..... H01R 4/50
(52) U.S. Cl. ..... 439/348; 439/258
(58) Field of Search ..... 439/188, 348, 439/322, 180, 137, 138, 944, 352, 186, 155; 200/51.09

(56) References Cited

U.S. PATENT DOCUMENTS 3,360,764 A * 12/1967 Bac ..... 339/45

* cited by examiner

*Primary Examiner*—Alex Gilman
(74) *Attorney, Agent, or Firm*—Akin Gump Strauss Hauer & Feld LLP

(57) ABSTRACT

A connector for interconnecting or mutually isolating two circuits one of which is connected to a first connector element (1) and the other of which is connected to a second connector element (2) which is interengageable with the first. One of the connector elements supports a first contact (12) connected to a respective circuit and a displaceable contact holder (4) carrying interconnected second (14) and third (15) contacts. The contact holder is displaceable between a first position in which the first (12) and second (14) contacts are separated and a second position in which the first and second contacts are interconnected. The connector elements are formed such that on interengagement the contact holder is displaced from the first to the second position after the third contact is interconnected with a contact (34) of the other connector element (2). The arrangement is such that on disengagement of the connector elements (1, 2) the contact holder is displaced from the second to the first position. The contacts are arranged such that on disengagement the first and second contacts separate before the third contact is separated from the other connector element and such that when separated the first and second contacts are located within a closed chamber defined within the connector element in which the contact holder is supported.

12 Claims, 15 Drawing Sheets

ISOLATING CONNECTOR

CROSS-REFERENCE TO RELATED APPLICATIONS

This application claims priority to: PCT Application No. PCT/GB00/00312 filed on Feb. 4, 2000; and Great Britain Application No. 9902467.1 filed on Feb. 5, 1999.

BACKGROUND OF THE INVENTION

The present invention relates to an isolating connector for interconnecting or mutually isolating two or more circuits.

Electrical connectors are required which can be used safely in applications where the connectors may be exposed to explosive atmospheres. Such applications are found in industrial plants, for example in the oil, gas, petrochemical and mining industries.

Industrial plants are zoned according to the likelihood of explosive gases being present. Various protection measures are used to prevent explosions. The International Electromechanical Commission (OEC) has established standards which should be applied in particular circumstances, for example the Exd standard. Connectors in accordance with the Exd standard should be capable of being used in an explosive atmosphere such that if two interengageable connector elements of the connector are separated and a spark is generated any resultant explosion occurs within the connector structure and is prevented from being transmitted to the surrounding environment. To meet these standards, the connector must be capable of withstanding pressure developed within the connector as a result of an internal explosion and preventing the transmission of the explosion along any flame path defined between components of the connector. Exd standard connectors are available at present but generally meet the standard requirements only if prior to disconnection of the connector elements no power is supplied to the connector elements. To prevent accidental disconnection when power is still being supplied to the connector, such connectors must be marked clearly with for example "do not separate when energised" and the connector elements must be secured together by means of special fasteners which prevent accidental release.

It is an object of the present invention to provide a connector which can meet stringent safety requirements even if elements of the connector are separated when still connected to a source of electrical energy.

SUMMARY OF THE INVENTION

According to the present invention, there is provided a connector for interconnecting or mutually isolating two or more circuits, comprising first and second interengageable connector elements each of which is connected in use to a respective circuit and at least one of which supports a first contact connected to the respective circuit and a displaceable contact holder carrying interconnected second and third contacts, the contact holder being displaceable between a first position in which the first and second contacts are separated and a second position in which the first and second contacts are interconnected, wherein the connector elements are formed such that on interengagement the contact holder is displaced from the first to the second position after the third contact is interconnected with a contact of the other connector element, and such that on disengagement the contact holder is displaced from the second to the first position, the contacts being imaged such that on disengagement the first and second contacts separate before the third contact is separated from the said contact of the other connector element and such that when separated the first and second contacts are located within a closed chamber defined within the said at least one connector element, means being provided for locking the or each contact holder 10 the said contact of the other connector element unless the first and second contacts are separated.

Each connector element may support a respective first contact and a respective displaceable contact holder carrying interconnected second and third contacts such that on interengagement of the connector elements the third contacts are interconnected. Means may be provided to prevent the or each contact holder being blown out of the associated connector element. The preventing means may comprise a pin received in a slot formed in the contact holder.

The or each contact holder is preferably slidable in a bore such that the closed chamber is defined between the contact holder and the walls of that bore. Preferably, the locking means provided for locking the or each contact holder to the said contact of the other connector element comprise one or more locking balls which are retained in locking engagement between the connector elements and the contact holder unless the contact holder is in the first position.

Means may be provided for locking the or each contact holder in the first position when the connector elements are separated. Preferably the locking means maintains the or each contact holder in the first position unless the contact elements are interengaged, and may comprise a spring-biased slider displaceable as a result of interengagement of the connector elements from one position in which it reins one or more locking balls in locking engagement between the connector element and the contact holder with the contact holder in the first position and a further position in which each locking ball is released and the contact holder is displaceable to the second position.

BRIEF DESCRIPTION OF THE DRAWINGS

An embodiment of the present invention will now be described, by way of example, with reference to the accompanying drawings, in which.

DETAILED DESCRIPTION

Figure 1:
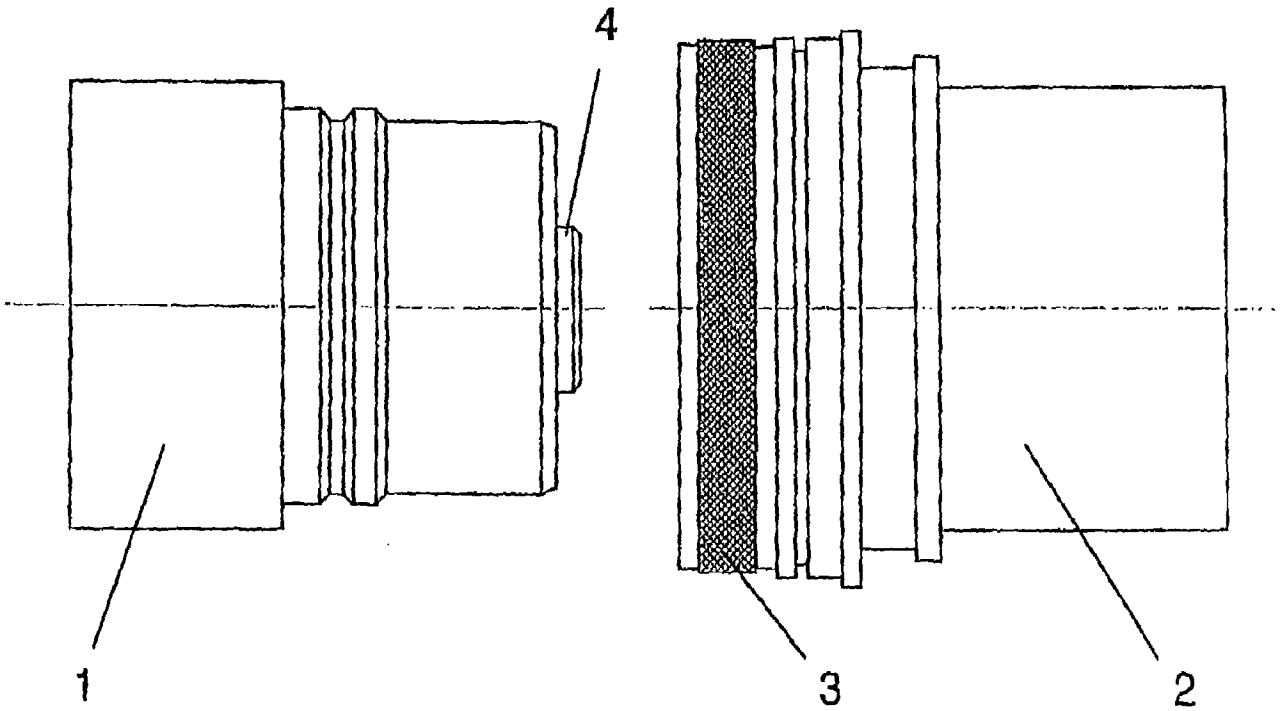
FIG. 1 is an outside view of the two connector elements making up a connector in accordance with one embodiment of the present invention.

Referring to FIG. 1, the illustrated connector assembly comprises a male connector having an outer body 1 and a female connector having an outer body 2. A collar 3 is slidably supported on the female connector outer body 2. The tip of a male body sliding contact holder 4 is also visible.

Figure 2:
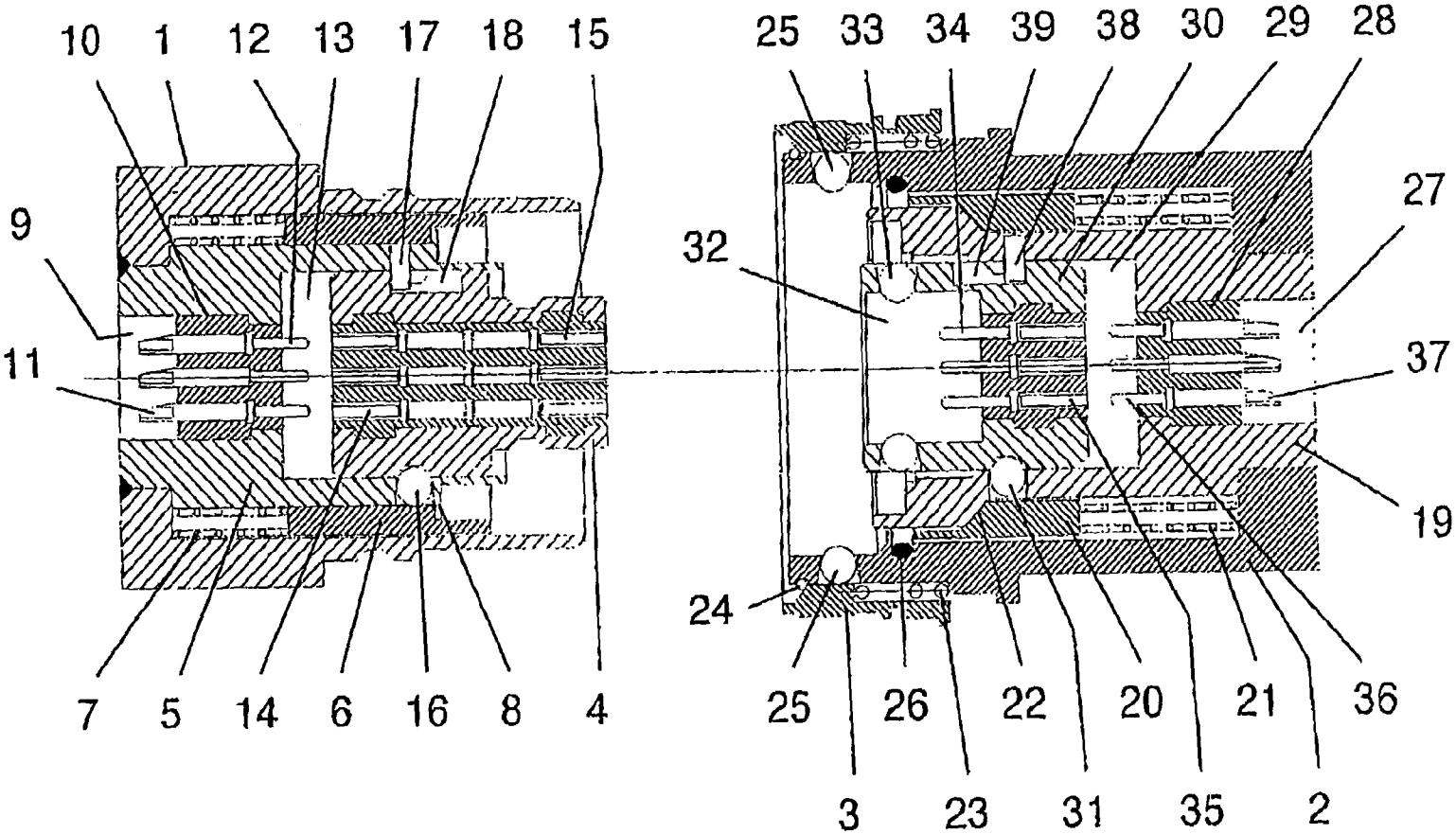
FIG. 2 is a sectional view through the connector assembly of FIG. 1.
Figure 3:
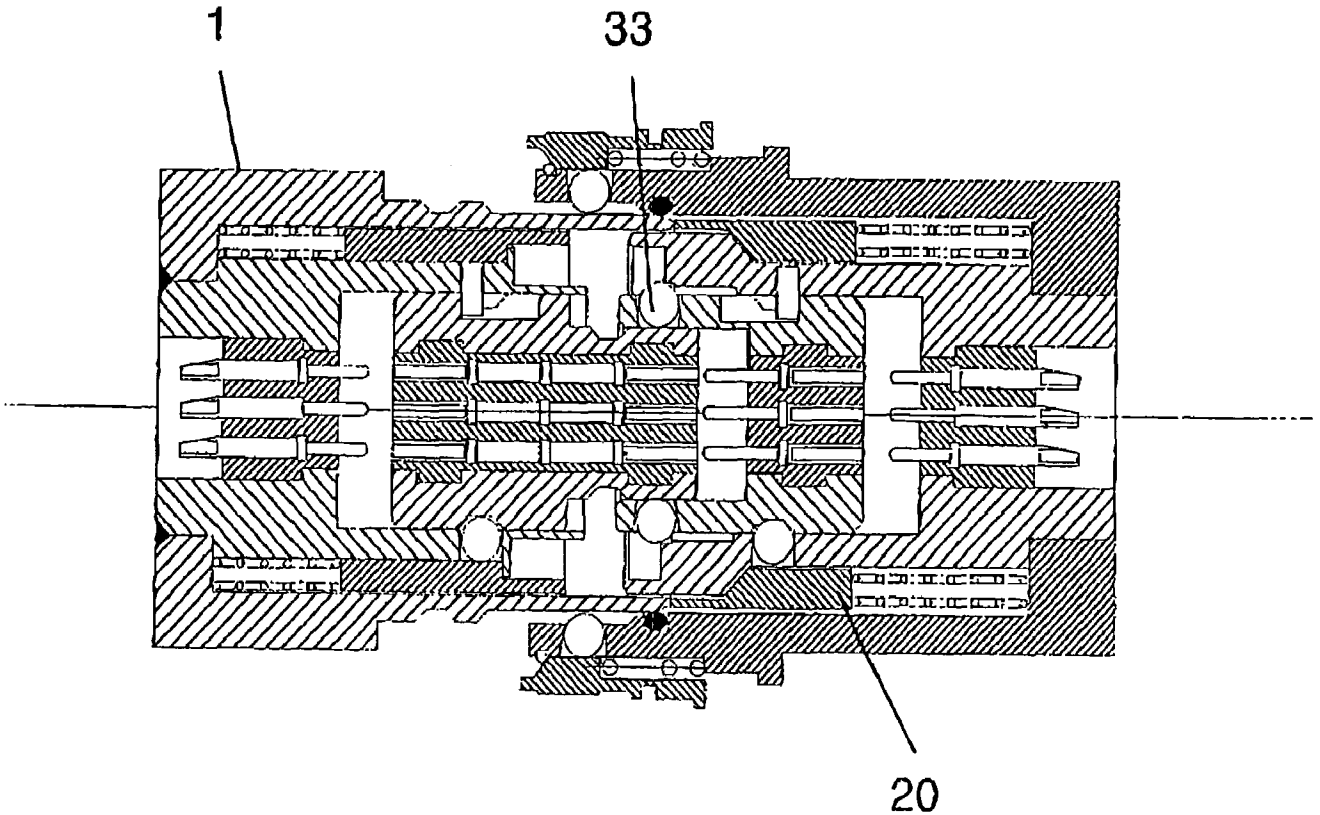
FIGS. 3 to 9 illustrate successive stages in the interconnection of the connector element shown in FIGS. 1 and 2.

Referring to FIG. 2, this view corresponds to that of FIG. 1 but shown in axial section to reveal the internal structure of the male and female connectors. The male connector outer body 1 fixedly supports a male connector inner body 5, an annular recess being defined between the inner and outer bodies. A male connector slider 6 is slidably received within the recess between the inner body 5 and the outer body 1 and a series of compression springs 7 biases the slider 6 against a flange 8 supported by the inner body 5. The inner body 5 defines a socket 9 in which a male connector fixed contact holder 10 is received. Cable solder pots 11 extend into the socket 9, and the holder 10 supports first male contact pins 12 which project into a further socket 13 defined by the inner body 5.

The pins 12 face first female contacts 14 supported in the sliding contact holder 4. The sliding contact holder 4 also supports second female contacts 15 which are electrically connected to the first female contacts 14. The holder 4 is slidable within the socket 13 but is retained in the position shown in FIG. 2 by a lock ball 16. The maximum spacing between the pins 12 and the first female contacts 14 is determined by the position of a retention pin 17 that is received within a slot 18 formed on the outer surface of the holder 4. The pin 17 is fixedly mounted in the male connector inner body 5, providing radial orientation and preventing total withdrawal of the sliding contact holder 4 from the inner body 5.

The female connector outer body 2 fixedly supports a female connector inner body 19. An annular slot is defined between the outer body 2 and the inner body 19 and receives a female connector slider 20 which is biased by a compression spring 21 against a frusto conical surface 22 defined by the inner body 19. A compression spring 23 biases the collar 3 against a retaining circlip 24. A lock ball 25 is supported in a tapering opening in the female connector outer body 2. An O-ring seal 26 is also provided in an annular groove inside the open end of the female connector outer body 2.

The female connector inner body 19 defines a socket 27 which receives a female connector fixed contact holder 28. The inner body 19 also defines a socket 29 which slidably receives a female connector sliding contact holder 30. In the separated condition of the connector assembly the sliding contact holder 30 is locked in position by a lock ball 31. The sliding contact holder 30 defines a socket 32 the wall of which carries lock balls 33 and into which second male contact pins 34 project. The pins 34 are connected to third female contacts 35 also carried by the sliding contact holder 30. The third female contacts 35 face third male contact pins 36 ex-ending from the fixed contact holder 28. The third male contact pins 36 are connected to cable solder pots 37 which project into the socket 27.

The maximum spacing between the third female contacts 35 and the third male contact pins 36 is determined by retention pin 38 carried by the inner body 19. The retention pin 38 is received in an elongate slot 39 formed in the outer surface of the female connector sliding contact holder 30. The pin 38 provides radial orientation and prevents total withdrawal of the contact holder 30 from the inner body 19.

Figure 4:
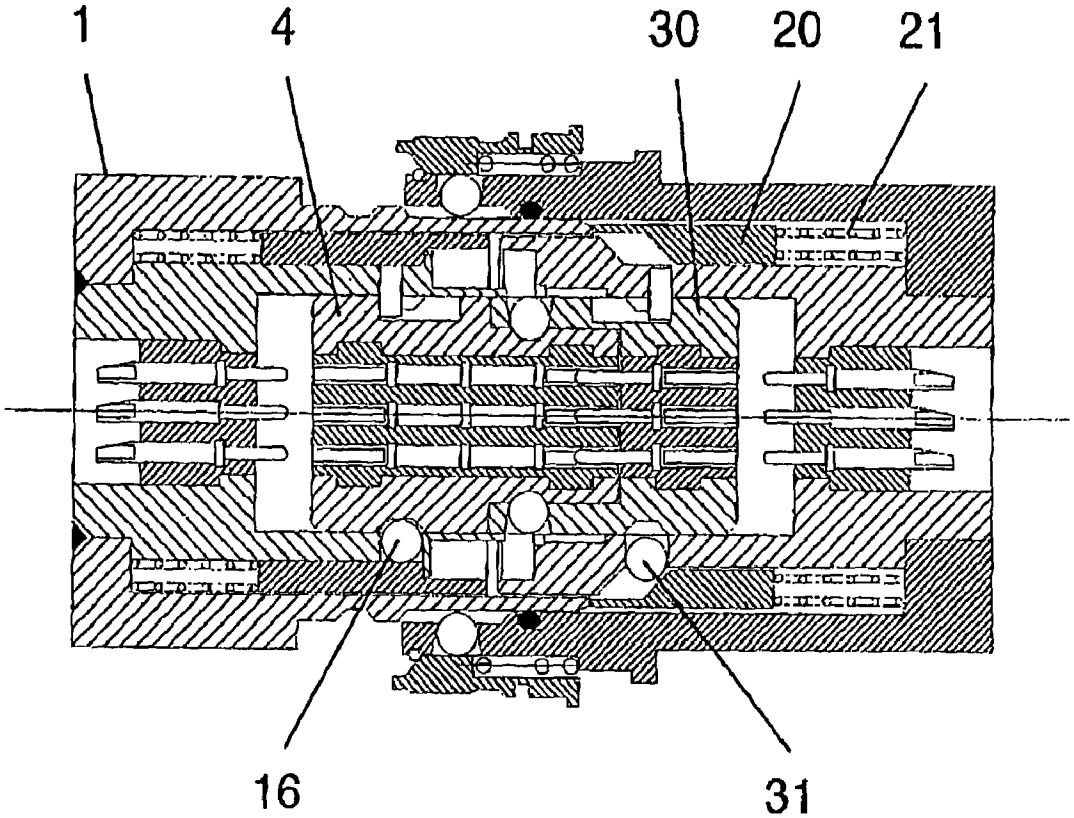

Referring now to FIGS. 3 to 9, the interaction of the various components described with reference to FIG. 2 as the male and female connectors are brought together will be described. As the tip of the male connector outer body 1 is advanced into the female connector body 2 the lock balls 33 are pushed radially outwards and the O-ring seal 26 is compressed. The tip of the male connector outer body 1 then contacts one end of the female connector slider 20. As the male connector is advanced further into the female connector the slider 20 is pushed back against the compression spring 21. Initially the lock ball 31 secures the sliding contact holder 30 against axial displacement and as a result the male connector sliding contact holder 4 which in turn is locked against axial displacement by lock ball 16 advances so as to push the second female contacts 15 onto the second male contact pins 34. Once the female connector slider 20 has moved far enough against the biasing force of the spring 21 the lock ball 31 can move away from the female connector sliding contact holder 30 so as to enable axial displacement of the contact holder 30. FIG. 4 shows the assembly just after the lock ball 31 has released the holder 30 for axial displacement.

Figure 5:
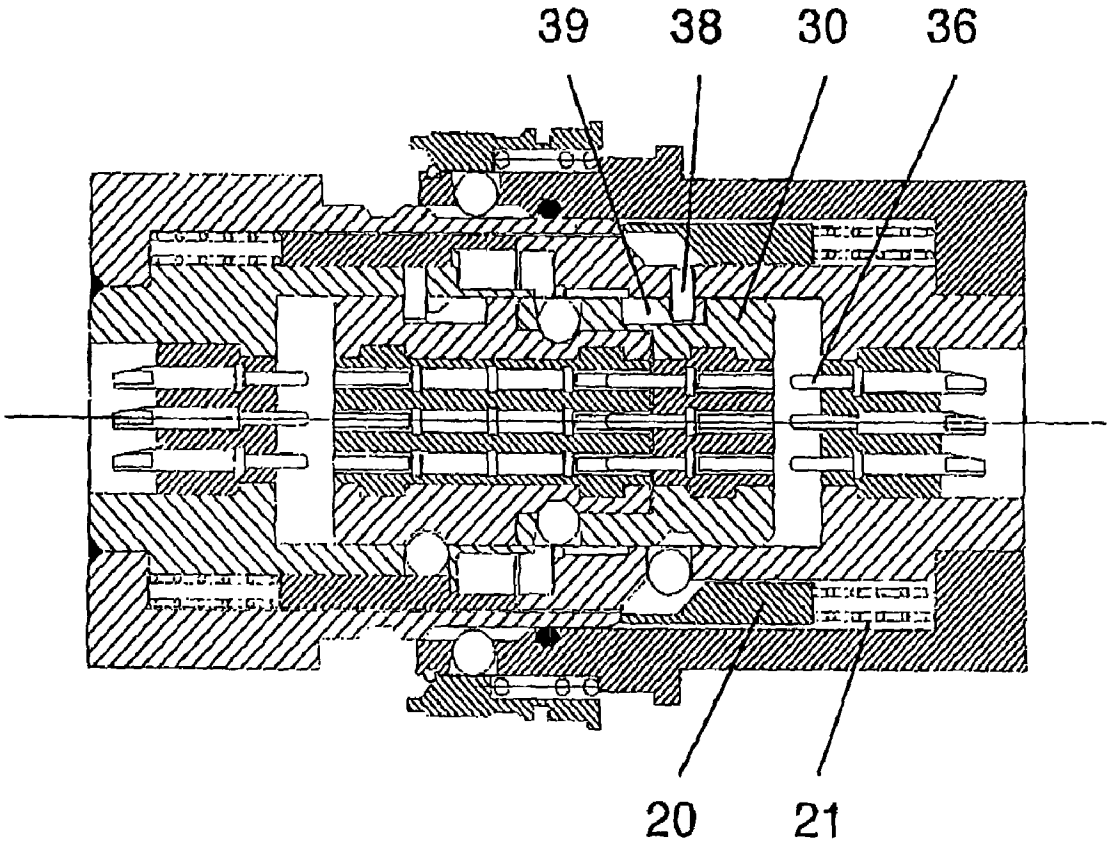

Referring to FIG. 5, as the male connector is pushed further into the female connector, the slider 20 is pushed back further against the biasing force of the spring 21 and the contact holder 30 advances towards the third male contact pins 36. As a result the retention pin 38 is no longer at one end of the slot 39.

Figure 6:
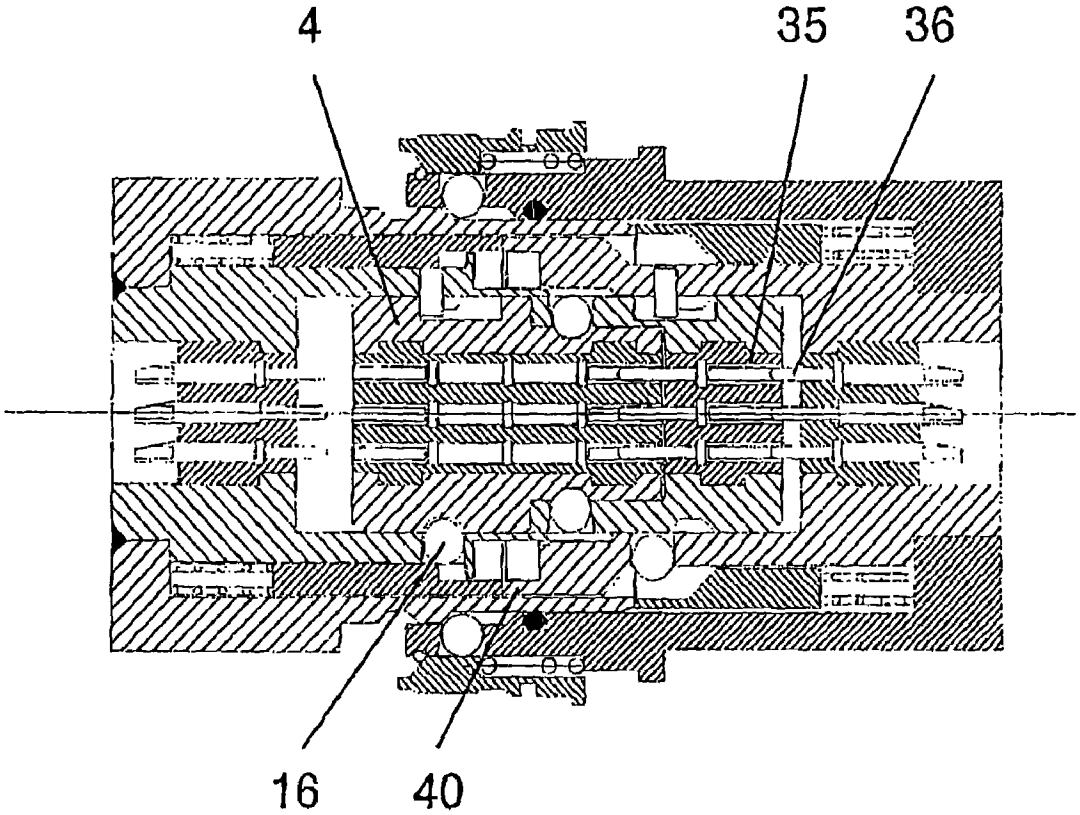

As shown in FIG. 6, further advancement of the male connector pushes the third female contacts 35 onto the third male contacts 36. Te lock ball 16 still prevents axial displacement of the male connector sliding contact holder 4.

Figure 7:
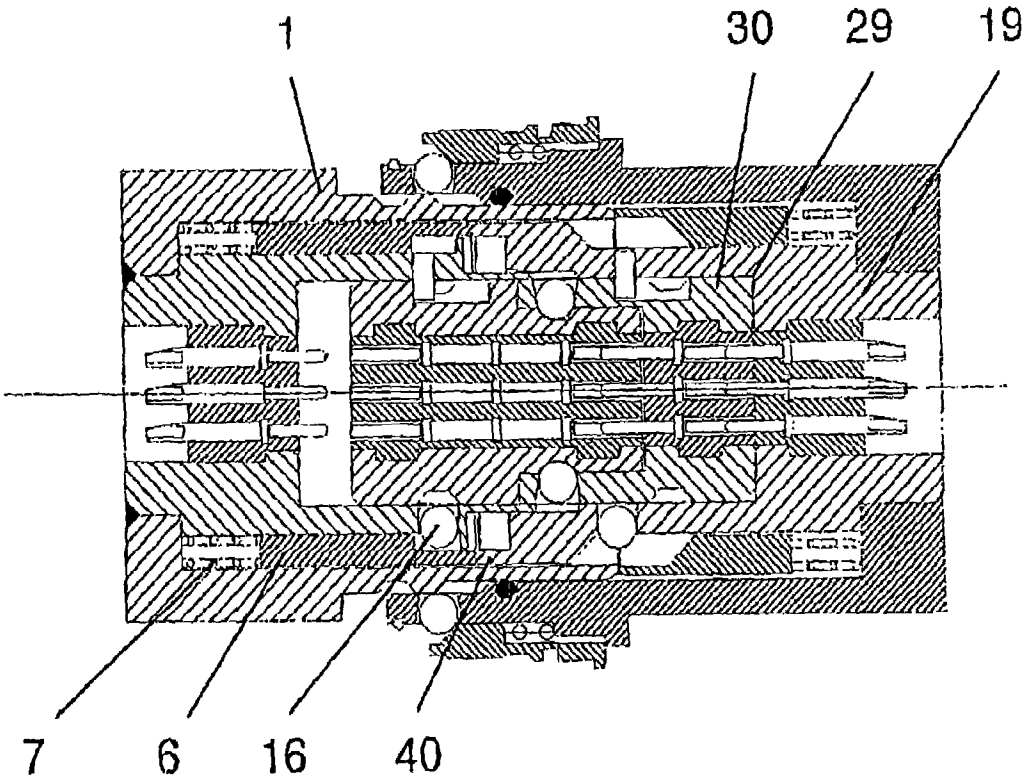
Figure 8:
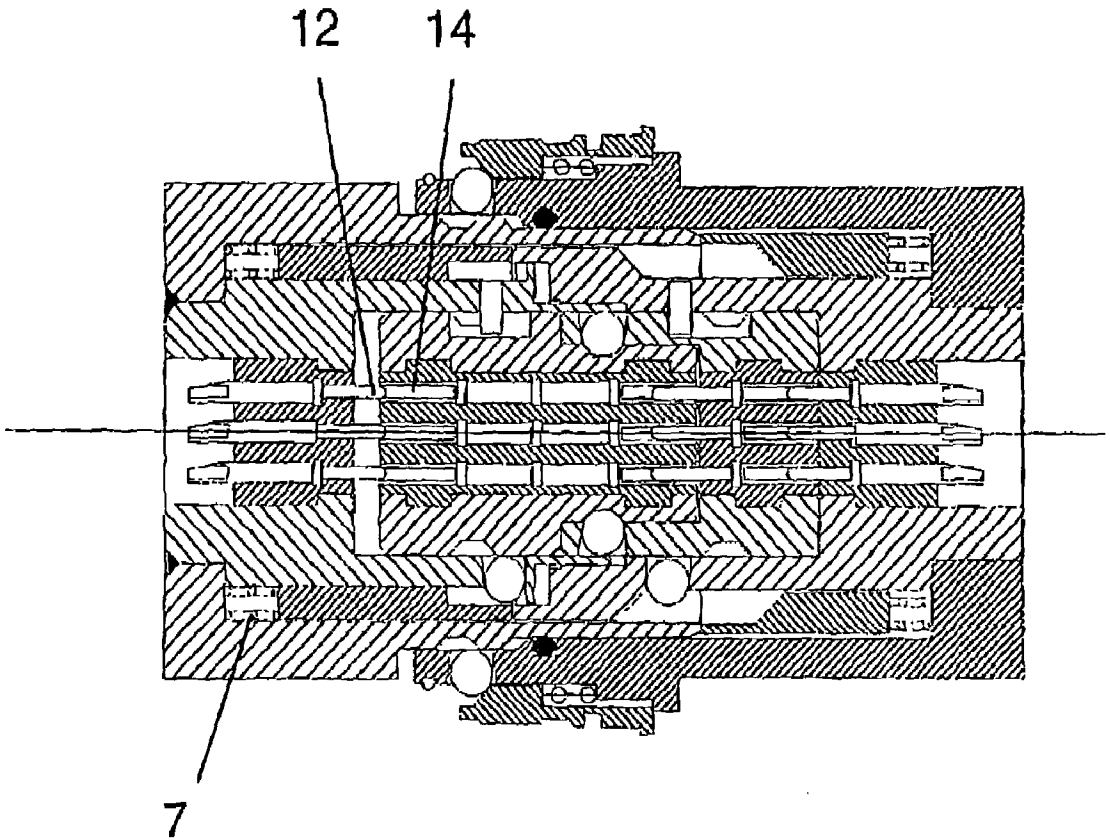
Figure 9:
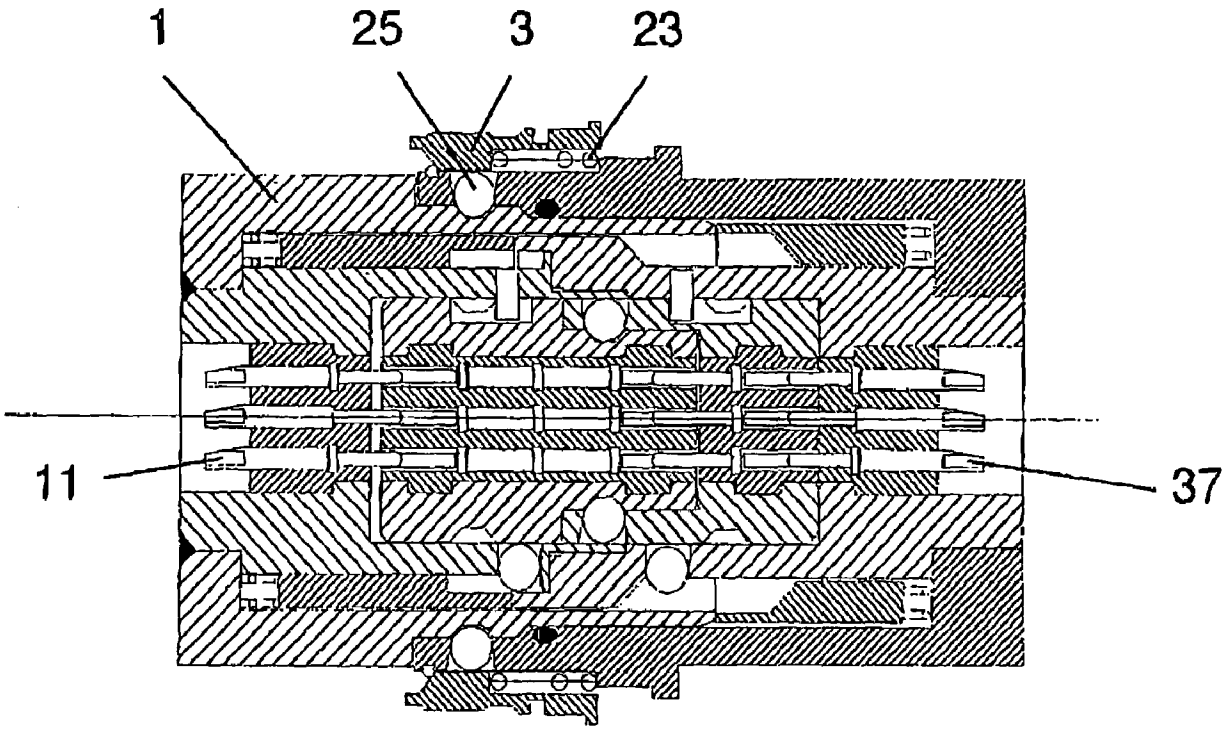

FIG. 7 shows the relative positions of the various components immediately after the female connector sliding contact holder 30 has been pushed up against the bottom of the socket 29 defined by the inner body 19 of the female connector. It will be seen that the tip 40 of the inner body 19 has pushed the male connector slider 6 back against the biasing force of the spring 7 to a sufficient extent that the lock ball 16 can move out of engagement with the male connector sliding contact holder 4. Further advancement of the male corrector outer body 1 into the female connector causes further compression of the spring 7 as shown in FIG. 8 until the first male contact pins 12 enter the first female contacts 14. The male connector is then pushed fully home to the position shown in FIG. 9, in which position the lock balls 25 are pushed into an annular depression formed in the outer body 1 of the male connector, the lock balls 25 being retained in position by the collar 3 which is pushed over the lock balls 25 by the spring 23. Thus the cable solder pots 11 are directly connected to the cable solder pots 37 through a series of three connections each defined by male contact pins received in female contacts.

Figure 10:
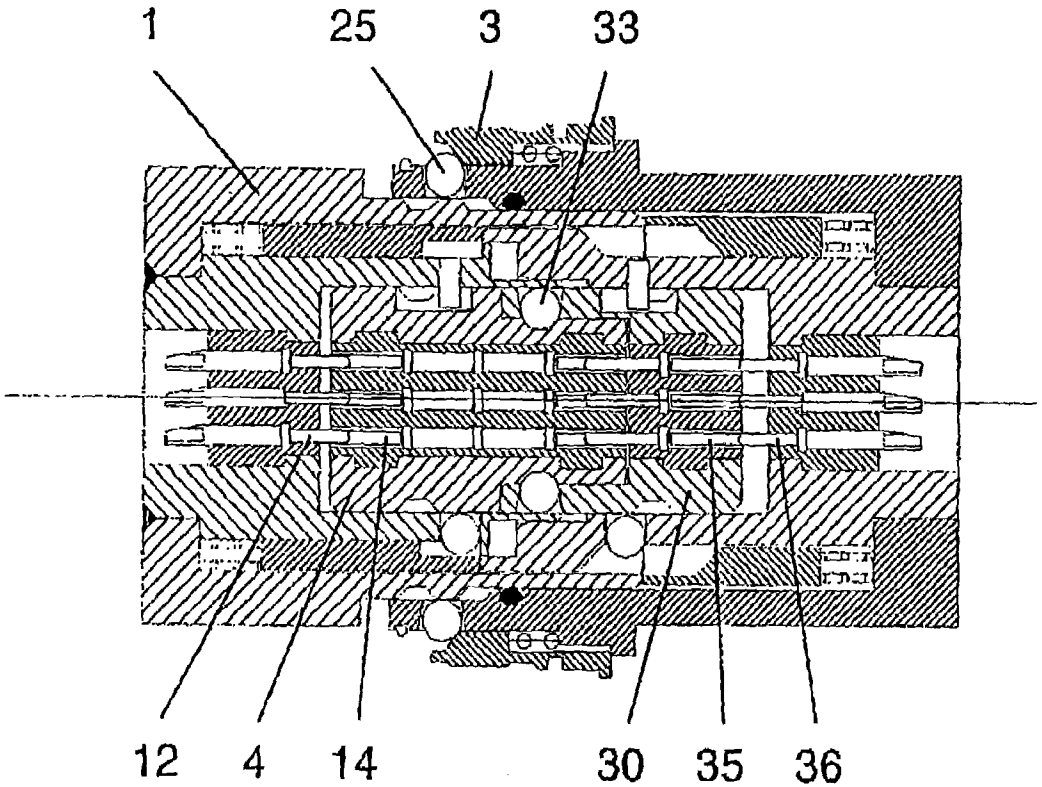
FIGS. 10 to 15 illustrate the sequence of component movements which is followed as the two connector elements are separated.
Figure 11:
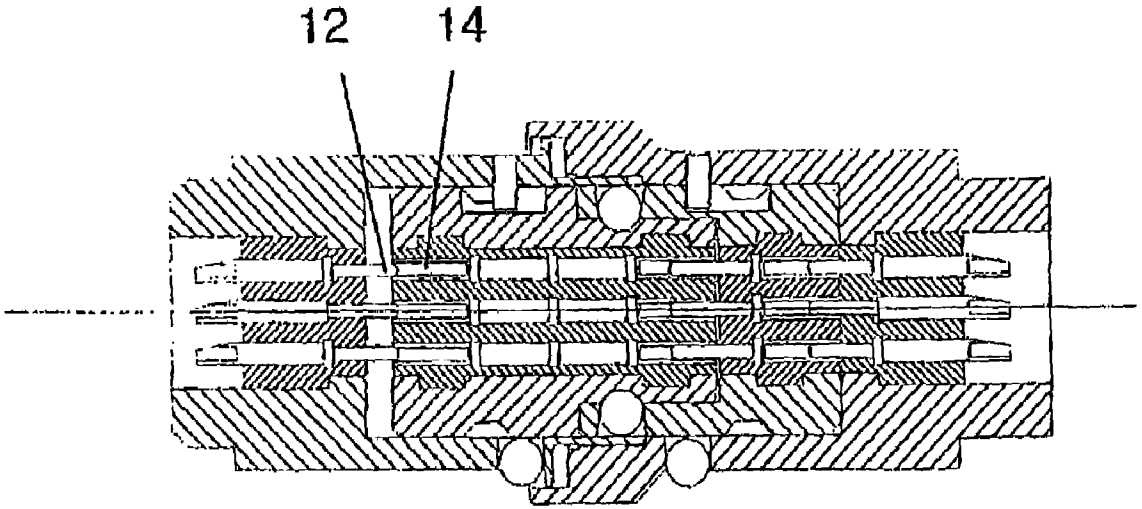
Figure 12:
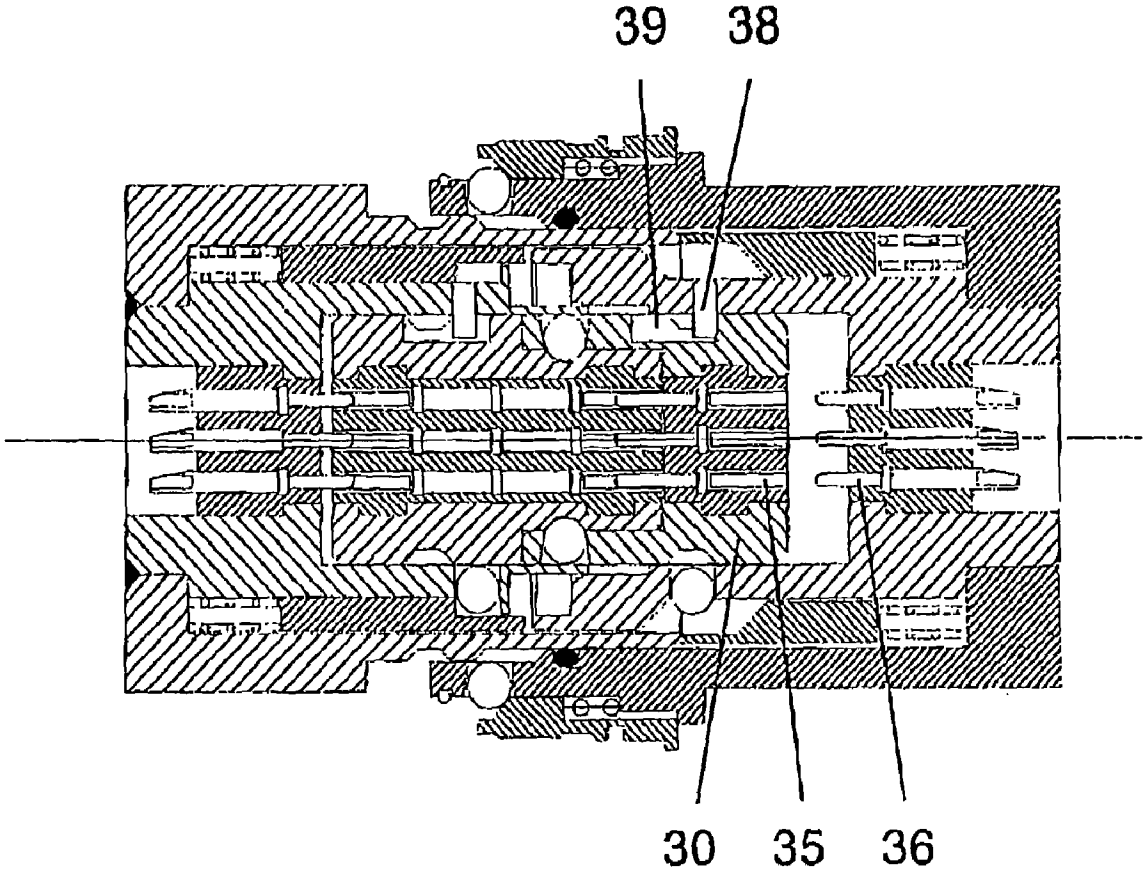

Referring now to FIGS. 10 to 15, the sequence of component movement which is followed as the male and female connectors are separated will be described. Firstly, as shown in FIG. 10, the collar 3 is pulled back to release the lock balls 25. Tension is then applied between the collar 3 and the outer body 1 of the male connector so as to pull the two halves of The connector apart. The lock balls 33 prevent separation of the male connector sliding contact holder 4 and the female connector sliding contact holder 30. Thus the tension is applied to the connections between the first male pins 12 and female contacts 14 and the third male pins 36 and the female contacts 35. Depending upon which of these two pin and female contact connections presents the greatest frictional resistance to separation, either the pins 36 will be pulled out of the female contacts 35 as shown in FIG. 10 or the pins 12 will be pulled out of the female contacts 14 as shown in FIG. 11 (FIG. 11 shows only the internal components of the connector). Further separation of the male and female connector parts moves the assembly to the position as shown in FIG. 12 (if initial separation was between pins 36 and female contacts 35 as shown in FIG. 10) or moves the components of the assembly to the relative positions shown in FIG. 13 (if initial separation was between the pins 12 and the female contacts 14 as shown in FIG. 11). Thus the two contact holders which are locked together have been separated from either the male connector fixed contact holder 10 or the female connector fixed contact holder 28.

Figure 14:
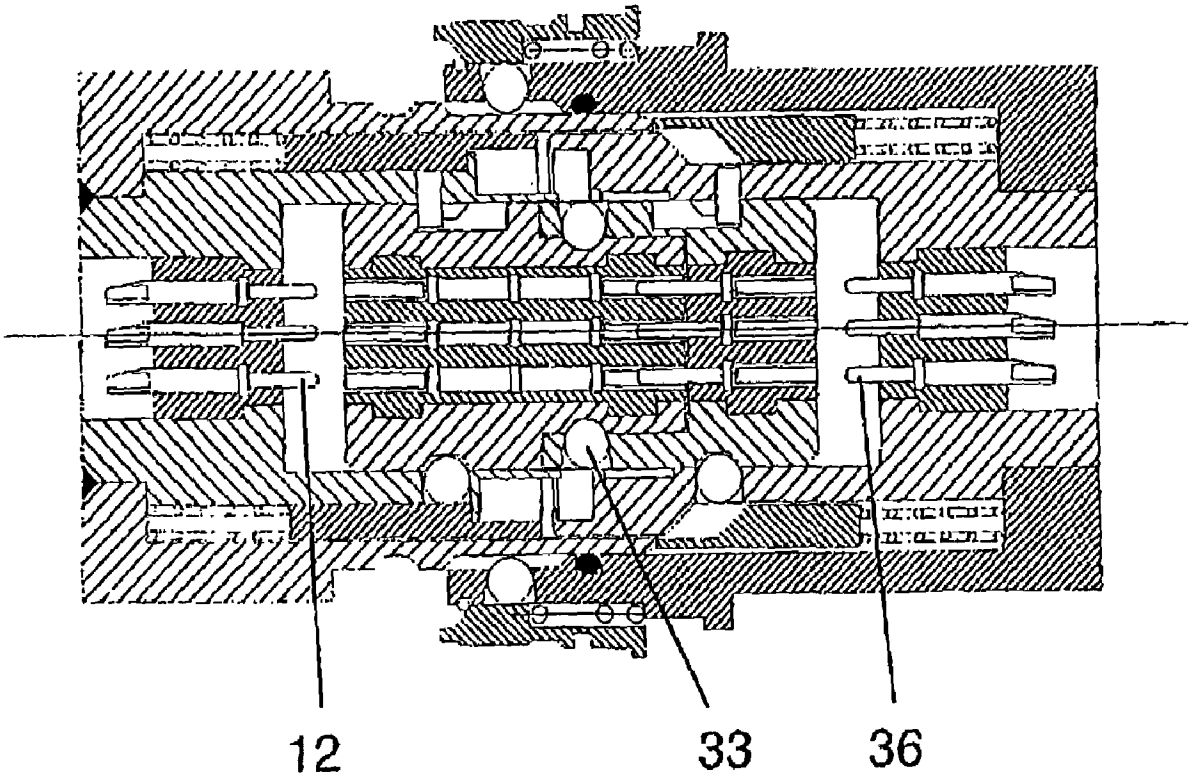
Figure 15:
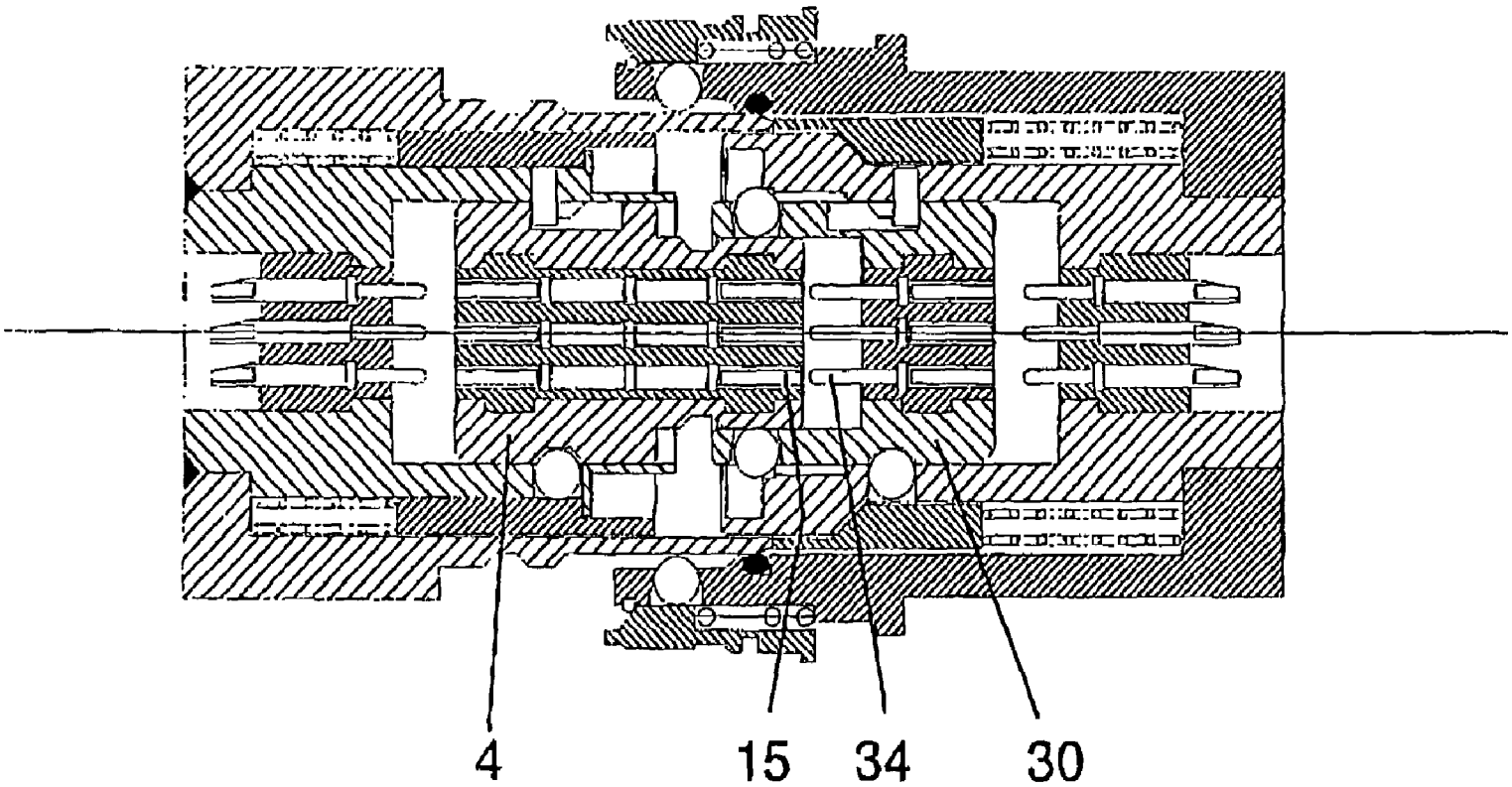

The male and female connector sliding contact holders remain locked together and thus as the male and female connectors are pulled farther apart the assembly components assume the condition shown in FIG. 14 in which the locked-together sliding contact holders are electrically isolated from the first male connector pins 12 and the third male connector pins 36. As the male and female connector parts are pulled further apart to the positions shown in FIG. 14 the lock balls 33 are released and as a result the two sliding contact holders 4 and 30 can separate as shown in FIG. 15. As a result the second male contact pins 34 are pulled out of the second female contacts 15. All three sets of male pins and female contacts are thus separated and further separation of the two halves of the connector can then proceed.

Figure 13:
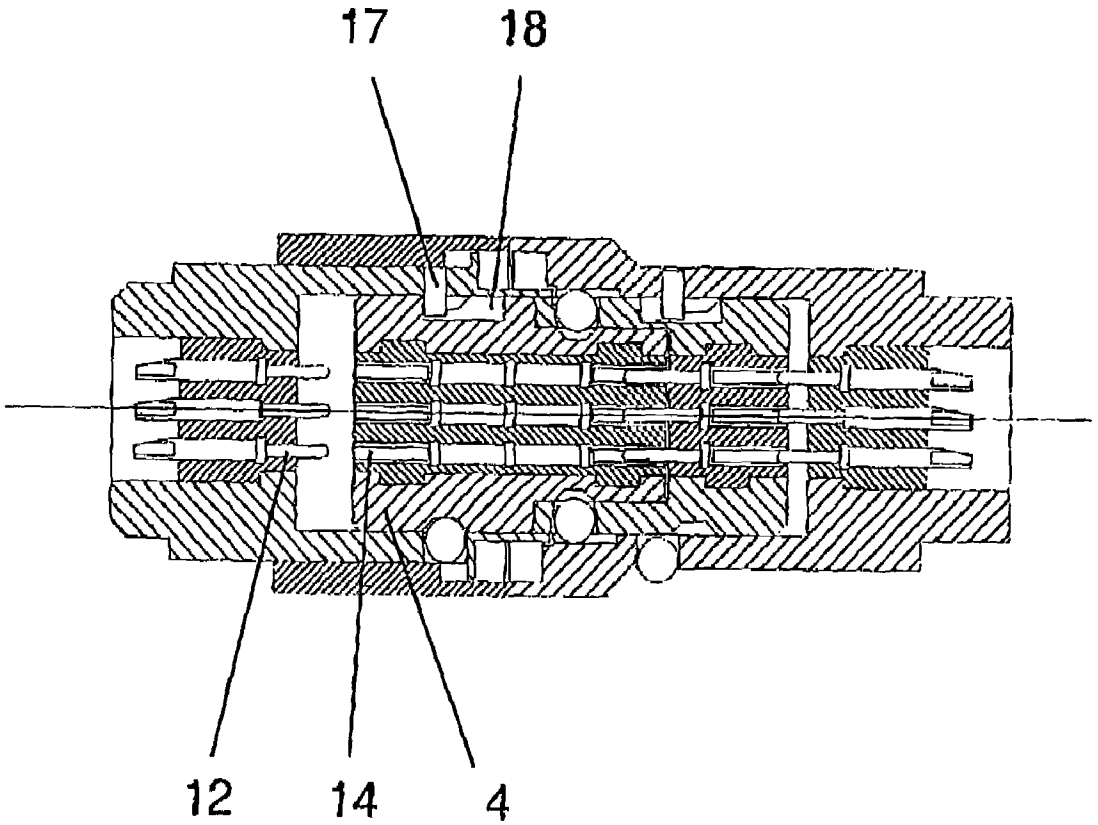

Assuming that when making or breaking a connection with the illustrated connector power is applied between the cable solder ports 11 and 37, connection or disconnection of the connector assembly will nevertheless be achieved in a safe manner. For example, if as shown in FIG. 12 the electrical circuit is broken first as a result of separation of the male pins 36 and the female contacts 35, any resultant spark will be generated in the closed compartment defined around the pins 36. Even if that compartment is filled with an explosive mixture of gas which is ignited as a result of spark generation, the volume of gas ignited will be relatively small. A gas explosion in the closed compartment will result in an axial force being applied to the female connector sliding contact holder 30 but that contact holder will be prevented from being blown out of the assembly as a result of interengagement between the retaining pin 38 and the slot 39. Heat generated by the confined explosion will be rapidly absorbed by the connector body, and the length of any leakage path from the closed compartment in which the explosion has occurred to the exterior of the connector will be such that the explosion cannot be propagated to the atmosphere outside the connector. Similarly, if the first break in the electrical connection through the connector assembly is a result of the pins 12 being pulled out of the female contacts 14 as shown in FIG. 13, any spark will be generated in the closed compartment defined around the pins 12 and the male connector sliding contact holder 4 will be retained within the connector body by interaction between the retaining pins 17 and the slot 18. Further separation of the device will result in the separation of two further sets of male pins and female contacts but no voltage will be applied across those connections at the lime of separation and accordingly no further sparks can be generated. The overall assembly is thus inherently secure against the risk of sparks being generated in a manner which could cause explosions to propagate outside the connector body.

Once the connector has been disconnected the two halves of the connector are in the condition as illustrated in FIG. 2. In that condition, the male connector sliding contact holder 4 is locked against axial displacement by the lock ball 16 and the female connector sliding contact holder 30 is locked against axial displacement by the lock ball 31. Thus even if a user was to inadvertently apply an axial force to one of the contact holders the contact holder would not be displaced axially and therefore could not make an electrical connection with any cable connected to the respective connector half. The overall assembly is thus inherently very secure against threats either to the safety of users or to the generation of explosions which could propagate to the surrounding environment.

It will be appreciated that alternative arrangements to those described in FIGS. 1 to 15 can be envisaged. For example sprung contact arrangements could be used in place of the illustrated pins and sockets. Spring loaded arrangements could be provided to apply a bias force to assist separation of particular pins and sockets in a predetermined order. A captive screw thread ring nut or staplelock system could be used to hold the collar 3 in a locked position so as to reduce the risk of inadvertent connector separation. The sliding collars 6 and 20 could be multi-component assemblies. Furthermore, although in the illustrated connector only straightforward electrical connections are required, the connector could be used for combined electrical/fibre optic connection or for a fibre optic connection only. Combined connectors could also include pneumatic and/or hydraulic connections.

Further modifications to the illustrated connector arrangement are possible. For example, the springs of the illustrated embodiment could be replaced by foam rubber, compressable gas arrangements or a single large spring. The annular collars could be replaced by sliding rods or the like. Locking balls could be replaced by shaped pin or other locking elements. The retention posts could be replaced by anchor bolts, circlips, machine leas or lips or the like. Collars could be split into a series of independent elements to improve security against tampering. In the illustrated arrangement, the retention posts slide in axial slots which limit the maximum axial displacement of the contact holders. Other arrangements are possible however. For example a springloaded retention post could be slidable in a slot incorporating a first axially extending slot section and a second slot section which is inclined at an acute angle to the axial section. With such an arrangement if when the contact elements were disconnected an attempt was made to push back the contact holder, the springloaded retention post could cause the pin holder to rotate into a locked position, thereby preventing reconnection of the pins. With such an arrangement, the springloading, would cause rotation of the contact holder unless the contact holder was prevented from turning as a result of inierengagement with components of the other connector elements. For example, pins mounted on one contact element would engage in sockets of the contact holder of the other contact elements so as to prevent rotation of the contact holder. Such an arrangement would not positively lock the contact holders against axial displacement before connector element interengagement as is the case for the illustrated embodiment.

It will be appreciated that connectors in accordance with the invention may be provided with air or inert gas purging, to prevent the build-up of explosive gas mixtures in the closed chambers in which sparks may be generated, or the closed chambers may be filled with a non-flammable electrically insulating liquid.

What is claimed is:

1. A connector for interconnecting or mutually isolating two or more circuits, comprising first and second interengageable connector elements each of which is connected in use to a respective circuit and at least one of which supports a first contact connected to the respective circuit and a displaceable contact holder carrying interconnected second and third contacts, the contact holder being displaceable between a first position in which the first and second contacts are separated and a second position in which the first and second contacts are interconnected, wherein the connector elements comprise means for ensuring that on interengagement the contact bolder is not displaced from the first to the second position unless the third contact is interconnected with a contact of the other connector element, the connector elements comprise means for ensuring that on disengagement the contact holder is displaced from the second to the first position, and the connector elements comprise means for ensuring that on disengagement the first and second contacts separate before the third contact is separated from the said contact of the other connector element and such that when separated the first and second contacts are located within a closed chamber defined within the said at least one connector element, means being provided for locking the third contact of the contact holder to the said contact of the other connector element unless the first and second contacts are separated.

2. A connector according to claim 1, wherein the contact holder is slidable in a bore such that the closed chamber is defined between the contact holder and walls of the bore.

3. A connector according to claim 1, wherein the means for locking the contact holder to the said contact of the other connector elements comprise one or more locking balls which are retained in locking engagement between the connector element and the contact holder unless the contact holder is in the first position.

4. A connector according to claim 1, wherein means are provided to prevent the contact holder from being blown oat of the associated connector element.

5. A connector according to claim 4, wherein the preventing means comprises a pin received in a slot formed in the contact holder.

6. A connector according to claim 1, wherein each connector element supports a respective first contact and a respective displaceable contact holder carrying interconnected second and third contacts such that on interengagement of the connector elements the third contacts are interconnected.

7. A connector according to claim 6, wherein means are provided to prevent each contact holder from being blown out of the associated connector element.

8. A connector according to claim 7, wherein the preventing means comprises a pin received in a slot formed in the contact holder.

9. A connector according to claim 1, comprising means for locking the contact holder in the first position when the connector elements are separated.

10. A connector according to claim 9, wherein the locking means locks the contact holder in the first position unless the third contact is interconnected with the contact of the other connector element.

11. A connector according to claim 9, wherein the locking means maintain the contact bolder in the first position unless the connector elements are interengaged.

12. A connector according to claim 11, wherein the locking means comprise a spring-biased slider displaceable as a result of interengagement of the connector elements from one position in which it retains one or more locking balls in locking engagement between the connector element and the contact bolder with the contact holder in the first position and a further position in which the locking, ball is released and the contact holder is displaceable to the second position.

* * * * *